US006017280A

United States Patent [19]

Hubert

[11] Patent Number: 6,017,280

[45] Date of Patent: Jan. 25, 2000

[54] GOLF CLUB WITH IMPROVED INERTIA AND STIFFNESS

[76] Inventor: James Alexander Hubert, 6377 Stagg Ct., Springfield, Va. 22150

[21] Appl. No.: 08/988,961

[22] Filed: Dec. 11, 1997

Related U.S. Application Data

[60] Provisional application No. 60/035,259, Dec. 12, 1996.

[51] Int. Cl.[7] ..... A63B 53/04

[52] U.S. Cl. ..... 473/324; 473/345; 473/349

[58] Field of Search ..... 473/324–350, 473/287–292, 219

[56] References Cited

U.S. PATENT DOCUMENTS

| | | | |
|---|---|---|---|
| 3,975,023 | 8/1976 | Inamori . | |
| 4,023,802 | 5/1977 | Jepson et al. . | |
| 4,432,549 | 2/1984 | Zebelean | 473/345 |
| 4,681,321 | 7/1987 | Chen et al. . | |
| 4,815,739 | 3/1989 | Donica . | |
| 5,000,454 | 3/1991 | Soda . | |
| 5,058,895 | 10/1991 | Igarishi . | |
| 5,176,383 | 1/1993 | Duclos . | |
| 5,306,008 | 4/1994 | Kinoshita . | |
| 5,342,812 | 8/1994 | Niskanen et al. . | |
| 5,380,010 | 1/1995 | Werner et al. . | |
| 5,451,058 | 9/1995 | Price et al. . | |

*Primary Examiner*—Sebastiano Passaniti

[57] ABSTRACT

The present invention pertains to the striking head of a golf club designed to maximize both the distance a golf ball will travel and the "forgiveness" of the club to off-center hits. These two advantages are achieved by a novel approach to club head design for improving the properties of stiffness and moments of inertia. The increased stiffness reduces the energy absorbed by the club head, thereby increasing the distance the ball will travel. Increasing the moments of inertia increases the "sweet spot" or "forgiveness" of the club by reducing the rotation of the club head during off-center hits. This invention has application to putter, iron, and wood golf club heads. The approach is to concentrate the majority of the mass of the club head into one structural member in the shape of a ring. The ring is formed by attaching a low-density rigid striking face to a high-density rigid ring segment extending behind the face. For the putter and iron application, a lightweight cover is used to close the hole formed between the striking face and the ring segment. In the case of a wood-type head, a lightweight aerodynamic cover and sole plate are attached. The resulting club head has the highest moments of inertia obtainable while providing a high-rigidity structure for minimal energy loss and maximum distance. The present invention provides improved moments of inertia and stiffness for any club head size including the largest "oversized" titanium metal woods.

1 Claim, 6 Drawing Sheets

GOLF CLUB WITH IMPROVED INERTIA AND STIFFNESS

CROSS-REFERENCE TO RELATED APPLICATION

This application discloses subject matter entitled to the earlier filing date of provisional application number 60/035,259 filed on Dec. 12, 1996.

BACKGROUND OF THE INVENTION

Golf Clubs. The game of golf is played with three basic club types: putter, iron, and wood. Each of these clubs is formed of a head which strikes the ball and a shaft attached to the head and which is gripped by the golfer to control the head motion. The club head is mounted to the shaft by inserting the shaft into a receptacle provided on the head (typically referred to as a "hosel"). The putter head has a flat, generally vertically oriented surface to strike the ball and cause it to roll on the surface of the ground. The iron has a flat striking surface that is oriented at an angle inclined from the vertical to cause the ball to travel at varying angles upward depending on the club. Woods have a generally flat and inclined striking surface on a bulbous body, which is intended to reduce aerodynamic drag during the swing. The reduced drag allows higher club head velocity for increased distance. The rules of golf are provided by the United States Golf Association and the Royal and Ancient Golf Club of St. Andrews. These rules do not allow moving parts, appendages, holes through the club head, or club heads that are not plain in shape.

Each type of club head has a "sweet spot" or center-of-percussion which is the location on the striking surface at which the center of mass of the club head will be aligned directly behind the center of mass of the ball during impact. When a golfer hits a ball with the sweet spot of the club head, the minimum amount of energy is transmitted to the golf club from the ball and the resulting distance the ball travels is maximized. When the sweet spot is not struck, the misalignment of the centers of mass results in a moment that tends to twist the club head. This twisting serves to transmit energy to the golfer that could have been imparted to the ball. The twisting also results in some divergence of the ball from its intended path due to the angle of twist and the resulting spin imparted to the ball.

Putters. The striking surface of a putter is typically aligned within one degree of vertical, as its primary function is to cause the ball to roll smoothly on a relatively flat surface. A putter head is a rigid structure with the hosel placed at any location on the head. Sufficient rigidity of the putter head is simple to achieve, as the impact velocities are low. Some efforts to improve the "feel" of putters have gone towards use of different materials such as brass or copper. Other efforts to improve the feel have involved modifications of the striking surface by providing an insert of resilient material. The only other substantial design modification for putters has been limited efforts to improve the moment of inertia about a vertical (or "yaw") axis. These efforts have included the redistribution of mass to the inner and outer lateral ends of the striking surface relative to the direction of travel (or "heel" and "toe"). In addition, putter designers have created the "mallet" putter that accomplishes mass redistribution by extending the putter head in a semi-circular fashion to the rear of the striking surface.

Irons. The inclination from the vertical of the striking surface of an iron golf club head is commonly referred to as its "loft" and is measured in degrees. Irons are commonly available as a driver or #1 iron through a #9 iron and further as wedges for even shorter distances and sand shots. The #1 through #9 irons typically have from 15 to 45 degrees of loft while the wedges have from 45 to 65 degrees of loft. As the loft decreases, the shaft length increases to provide a higher club head velocity. A typical #9 iron or wedge has an approximately 36" shaft, whereas a #1 iron has a 40" or longer shaft. The mass of each head is usually matched to the shaft length to provide a constant centrifugal force or "swing weight."

The iron-type head is typically a rigid structure as there is sufficient mass available to design for high rigidity. Recent design improvements and use of high-strength materials have allowed redistribution of mass to increase the moments of inertia of the head. These modifications have resulted in irons with "perimeter weighting" and "oversized" irons. Perimeter weighting is redistribution of the mass to the perimeter of the striking surface to increase the moments of inertia. Oversized irons have an increased size of the striking surface through design and the use of high strength, low-density materials. This increase in size is accomplished specifically to increase the distance of the mass of the club head from its center of gravity—again increasing the moments of inertia.

Woods. A wood generally has less loft and a longer shaft than an iron in order to achieve greater distances. Woods are commonly available as a driver or #1 wood through a #9 wood with lofts ranging between 5 and 30 degrees and shaft lengths ranging between 48" and 41" respectively. Like the irons, the combination of smaller loft angle and longer shaft length increases the club head speed and resulting distance for the driver.

The original (and still available) construction of a wood-type head was to form a club head constructed of persimmon, a wood with low density and high stiffness (or modulus of elasticity). These club heads are made of solid wood resulting in a rigid body. As a result, the natural wood head transfers maximum energy to a ball struck at the sweet spot. The design was eventually modified by the application of metal to some portion of the striking surface and the bottom surface (or sole) for increased durability. The body volume provides a mass distribution with greater moments of inertia about the point of contact with the ball than a comparable iron of its time and also serves to significantly reduce aerodynamic drag. A solid wood club head has the disadvantage that its density limits its size and the resulting inertial properties, so the resulting size of the sweet spot is relatively small. The shaft length and club head mass are designed to generate a "swing weight" in a range which allows the golfer to achieve high circumferential velocity of the club head while maintaining proper control of its path.

Recent applications of materials and design features have revolutionized the design of wood-type heads. This has resulted in wood-type heads made of metal (commonly known as metal woods) and in wood-type heads made of polymer composite materials. The first application was the use of steel to replace the persimmon wood. It is likely that the main advantages sought were reduced manufacturing cost and increased durability. This application of material resulted in a hollow body to maintain the proper mass. A possibly unexpected benefit was a significantly improved mass distribution—with the mass all moved to the surface of the club head, the moments of inertia were significantly increased. This advantage is similar to that obtained through perimeter weighting used primarily for irons, but is actually more effective at increasing the moments of inertia. The use of a hollow body also introduced a problem that has to be dealt with in all hollow, wood-type head designs. This is due to a decrease in rigidity of the head structure as a result of the hollow design. To maintain the weight of the head within acceptable bounds, the walls must be fairly thin resulting in increased structural flexibility. A number of patents during this century have proposed stiffening features to the hollow design in attempt to overcome this problem. A structure that flexes during impact will absorb greater energy and, therefore, transfer less energy to the golf ball.

The next evolution for wood-type heads was to take advantage of higher strength materials by increasing the size of the club head, resulting in what is known as the "oversized wood." Without further information, the layman could easily conclude that the size of the club head directly provides the advertised larger "sweet spot" by providing a larger striking surface. However, the advantage is actually achieved through the increased moments of inertia provided by the larger size. The first of the improved materials used was stainless steel, which has the advantage of being corrosion resistant. With stronger materials, the structural rigidity could be improved, the head could be made larger with similar weight and rigidity, or the head could be made lighter to allow a longer shaft with higher impact velocity. This evolution was followed by the use of titanium which is lighter than steel for the same strength. Many manufacturers have used titanium to provide club heads that are over twice as large (in volume) as the original wood heads. Titanium has approximately half the density of stainless steel, but also has only half the stiffness. In this case, the lighter weight allows for thicker walls, which provides improved rigidity for the same mass of material—resulting in a somewhat even trade.

During the same timeframe as the introduction of titanium, graphite fiber reinforced epoxies and similar composites have been used in golf club heads. This material has one-third the density of titanium and, as a result, can provide lighter weight and/or larger head size. It is likely that similar stiffness to that provided by titanium heads can be achieved with composites, but the overall advantages remain to be seen.

The next evolution of the wood-type head will likely be the use of even more advanced materials such as metal-matrix composites, ceramics, and ceramic-matrix composites. The use of these materials began with application to face inserts to provide a rigid striking surface. However, this still left body flexure as a source of energy absorption while striking a golf ball. In U.S. Pat. No. 3,975,023, Inamori provides an early example of the use of a ceramic faceplate. The increased application of ceramics is inevitable, as the recent progress in the high-technology industry has yielded ceramics with high strength, high rigidity, and reasonably high fracture toughness.

In U.S. Pat. No. 5,342,812, Niskanen et al. disclose the use of such advanced materials through a method patent. This patent describes a mass in the shape of a golf club head made of either a ceramic- or metal-matrix composite material with either a metal- or ceramic-matrix insert intended to be used as a striking surface. The practical application of Niskanen's claims is not entirely clear. The logic that has resulted in hollow wood-type heads and their resulting thin walls is not obviated by the application of advanced ceramic- and metal-matrix composites. The achievable density is in the realm of 30% less than that of titanium. The patent makes vague references to tailoring material properties, but it would be difficult to cast or press a solid wood-type head (as implied by the patent) which would have the desired size and still be light enough to be useful.

The replacement of a hollow titanium shell with a hollow ceramic- or metal-matrix composite shell would allow somewhat thicker walls and resulting greater stiffness. However, ceramic-matrix composites have less than 20% of the fracture toughness and their durability would be in question even with the increased wall thicknesses obtainable. Niskanen did not describe such an application of these new materials. Manufacturing a good quality sample in the desired shape would likely be difficult and expensive at best. The use of a metal-matrix composite would allow higher fracture toughness, but the higher density of the materials would eliminate the weight advantage and corresponding wall thickness gains over titanium and the same difficulties would likely be encountered in manufacturing.

BRIEF SUMMARY OF THE INVENTION

The objective of this invention is to provide greater distance capability when striking a golf ball as well as improved trajectory characteristics when the golf ball is hit off-center. This invention proposes the use of a novel approach to club head design. The approach begins by defining an "ideal" golf ball-impacting device relative to rigidity and moments of inertia and maximizes the extent to which those properties can be tailored by using recently available materials. The resulting concept is appropriate for application to putter-type, iron-type, and wood-type golf club heads.

Physics. The advantages of rigidity and moments of inertia for improving golf club performance are based on mechanical physics principles. Rigidity is a function of both materials and structural design. The rigidity of common materials can be assessed by determining modulus of elasticity. A material with a large modulus of elasticity is more rigid than a material with a smaller modulus of elasticity. Assuming the ball is in contact with the club face for 4 milliseconds and leaves the club face at 200 feet per second, and assuming a sinusoidal acceleration profile, a peak force of over 5,500 pounds will be generated during impact. The less rigid a club head is, the greater the deformation of the club head will be when subjected to this peak load. Since energy is measured as a force applied through a distance, any deformation of the club head represents energy retained by the club head and not imparted to the ball in the form of velocity.

Moment of inertia is measured as mass times the distance from the center of mass of a body to the particles of mass which make up the body. Therefore, mass concentrated at one location has minimum inertia. A simple approach to increasing inertia is to have the mass concentrated at two locations. An idealized example would be to have two equal point masses joined by a massless rigid link of length 2r. In this case the moment of inertia about any axis perpendicular to the link is simply $mr^2$. However, since presently available materials have finite density and assuming the perpendicular extent is limited, the mass members will have some thickness. As a result, the achievable inertia will be less for any object of maximum length 2r. The highest practically achievable moment of inertia for an object is obtained for a circular ring of material and about the axis perpendicular to the plane in which the ring lies. This is because the same mass that in the previous case was concentrated at one location can be spread around the entire circumference of a circle of diameter 2r. As a result, the thickness of the ring-shaped mass member will be much lower than that of the two mass concentrations described above. A spherical shell has the largest moments of inertia when three orthogonal axes are equally important, but the magnitude is only ⅔ of the moment of inertia value for the perpendicular axis of a ring. Judging the impact of deviations from a circular ring on moment of inertia is straightforward. Any deviation from circular and any increase in thickness will decrease the moment of inertia.

Related Prior Art. As golf is such a popular pastime, the literature is replete with improvements and artifices to golf clubs. There is a tremendous volume of patented material available for review and a number of pertinent patents were found. One of the main objectives of the present invention is to improve the inertial properties of the golf club head. In U.S. Pat. No. 4,023,802, Jepson et al. disclose a means of improving a wood-type golf club head which uses a plastic reinforcing collar. This reinforcing collar is intended to provide a more durable means for attaching the shaft and to distribute some of the mass of the club head towards the heel and toe of the club head. The redistribution of mass is intended to provide some increase in the moments of inertia. However, the increase obtained is minimal if it exists at all, since the persimmon wood did not inherently have excess mass available for redistribution.

Another example of an invention intended to increase the moments of inertia was proposed in U.S. Pat. No. 4,815,739 by Donica. Donica uses a hoop of material extending from the heel and toe of the putter and proposes attaching the shaft to one or more spokes extending inwardly from the hoop. The spokes and shaft are not directly connected to the striking face of the club head. The inventor states that connecting the shaft to the striking face only at the heel and toe of the club head through the support structure of spokes and hoop will increase the moment of inertia of the club head and, therefore, its sweet spot. He says that "during an off-center strike of the ball, the inertial forces are dampened by the . . . support and radiating spokes which transmit the forces to the shaft, after the ball is struck." In actuality, since the putter head serves as a rigid body, the location of attachment of the shaft is immaterial to the moments of inertia and resulting sweet spot. Judging from the text, any gain in inertial properties provided by this invention is coincidental. One other invention proposes to increase the moments of inertia of a club head. In U.S. Pat. No. 5,058,895, Igarashi refers to a putter that has mass members aft of the inner and outer edges (or "heel" and "toe") of the striking surface and is connected to a third mass to the rear of the striking face. The putter has a horizontal stiffening plate and additional vertical stiffening ribs below the plate. This invention is an improvement over simple perimeter weighting in that it provides increased moments of inertia. However, much of the potential gain is lost by the use of a thin striking face and the addition of stiffening members to strengthen it. Igarashi proposes a triangular arrangement of mass members which is intended to provide "three dimensional weighting" to increase the moment of inertia of the club head. His description of the benefits relates that the three-dimensional weighting causes the center of gravity to be further back from the face than for perimeter weighted clubs. He proposes that this results in the instantaneous center of rotation at the time of impact being "behind the center of gravity relative to the club face" and that this phenomenon increases the "toothed rack effect." As in the case of the Donica invention described above, any increase in the moment of inertia provided by this invention is coincidental.

This leads to another main objective of the present invention, which is to increase the rigidity of the striking surface and head structure. In U.S. Pat. No. 5,380,010, Werner and Grieg propose a corrugated triangular truss member to provide rigidity to a club head. While the reinforcing member will be a rigid structure, it will not efficiently stiffen the striking surface or the aerodynamic shell. The mass used to generate the truss member will actually detract from the stiffness that could be obtained for the shell and the striking surface. This truss member is anchored in the rear to a weight member intended to increase the moments of inertia. While the placement of a weight member some distance away from the center of gravity will increase the moments of inertia, this concept is not likely to yield much excess weight that can be allocated to the weight member. In addition, the concentration of a weight member at one location is an inefficient means to increase moment of inertia as it tends to displace the center of gravity towards itself and the mass used does not contribute to club head rigidity.

In U.S. Pat. No. 5,176,383, Duclos uses similar logic in providing a stiffening tube extending rearward from the striking face. This concept has an optional mass placed in the tube at the rear of the club head. Duclos explains that placing the mass behind the center of percussion will increase the moments of inertia while providing for direct momentum transfer. This discussion repeats the misconception of Werner and Grieg that concentrating the mass behind the sweet spot will lead to efficient energy transfer. The only aspect of these designs leading to efficient energy transfer is the rigidity of the head structure. Concentrating the mass at one location merely results in less than optimum mass distribution.

Two other inventions are aimed at reinforcing the club head and striking surface. In U.S. Pat. No. 4,681,321, Chen et al. propose a composite reinforcing member within a hollow composite shell. This reinforcing member is much like that proposed by Soda with the addition of a top surface and multiple ribs between the striking surface and the rear of the shell. It has the same disadvantages of the Soda invention. In U.S. Pat. No. 5,451,058, Price et al. propose a single rib and a bottom surface to reinforce the shell and striking face. In addition, they have provided a set of reinforcing rings that attach to the striking face and pass through the rib. This may be a reasonable approach to reinforcing the face, but does not make efficient use of the mass for inertial properties.

Two patents propose to increase both the inertial properties and rigidity of golf club heads. In U.S. Pat. No. 5,000,454, Soda proposes a hollow, fiber reinforced plastic club head with a reinforcing weight member contained within. His approach is to trade some of the thickness of the plastic material behind the striking face for mass to be used for the reinforcing weight member. The reinforcing weight member is intended to add stiffness to the striking face and around the perimeter of the club head, as well as to distribute mass around the perimeter of the club head to increase moments of inertia. Excess mass for the reinforcing weight member is obtained by using a plastic by having a thinner striking face. This invention can provide some increase in the moments of inertia and stiffness, but the advantages are limited by the mass that is retained by the plastic club head. The plastic club head is the primary structural and ball-striking device and the weight member is provided on the interior of this club head. The gain in moments of inertia and stiffness are limited in two ways by this invention: 1) the mass available for the reinforcing weight member is limited to the mass saved by having a thinner striking face and 2) the dimensions of the reinforcing weight member are limited by the inner dimensions of the plastic club head.

Another invention discusses both inertial properties and rigidity of the club head. In U.S. Pat. No. 5,306,008, Kinoshita proposes the use of a rigid beam extending laterally from heel to toe along the center of the striking surface to reinforce the striking face. This is combined with placement of mass members at the heel and toe to provide equal momentum of the heel portion and toe portion during a typical golf swing. Kinoshita makes reference to the high moment of inertia of the reinforcing beam, but he is referring to its cross-sectional moment of inertia, which improves the rigidity provided to the striking face. While placement of the mass members at the heel and toe provides the typical advantages of perimeter weighting, equalizing the momenta of the heel and toe portions is not intended to increase the moments of inertia. The inventor claims the reinforcing beam increases the moment of inertia of the club head. While he admits the "high moment of inertia" he ascribes to the beam actually refers to the second moment of area which relates to beam stiffness, he goes on to confuse this "moment of inertia" with the moment of inertia of the club head. In actuality, the invention proposed would likely result in a lower moment of inertia than that provided by a typical perimeter weighted club head. Although there is no discussion of the mass distribution of the striking face and its reinforcing beam compared to that of the prior art, the implication of the inventor's description is that the beam is in addition to the typical striking face. In such a case, the reinforcing beam would reduce the amount of mass available for placement at the heel and toe for improved moment of inertia..

Present Invention. The departure of this invention from previous art is to make a revolutionary change in golf club heads through a novel approach to each aspect of the head design. A golf club head with the optimum stiffness and moments of inertia is achieved in the following manner. As described above, the largest moment of inertia about a single axis is achieved in a circular ring. A horizontal ring has a moment of inertia about the vertical (or "yaw") axis of $mr^2$, where m is the mass and r is the radius of the ring. In this case, the moments of inertia about the lateral (or "pitch") axis extending from the heel to the toe and the longitudinal (or "roll") axis extending forward toward the ball are $\frac{1}{2}mr^2$. Larger pitch and roll moments of inertia can be obtained at the expense of the yaw moment of inertia by use of a spherical shell. In that case, all three moments of inertia are $\frac{2}{3}mr^2$. For this invention, it is assumed that the yaw direction is most important and, therefore, the ring is the ideal shape.

To adapt this ideal shape to a golf club, a rigid, generally flat striking plate is formed of low-density material and is attached to a rigid inertial and stiffening ring of high-density material. The lower density in the striking plate is required for two reasons: 1) the vertical width of the striking plate is generally large compared to the practical dimensions of the ring and 2) the relative flatness of the striking plate makes the mass distribution of the plate less efficient with respect to the moments of inertia. The striking plate and inertial ring must be rigidly attached to each other. A putter or iron head utilizing this invention would require a very lightweight cover between the striking plate and the inertial ring in order to meet golf club regulations. The cover could be as simple as a thin plate covering the hole created by the striking plate and inertial ring. For a putter, this cover would not have to be rigid. For an iron, some rigidity would be desirable for durability during impact. A wood head utilizing this invention would have a lightweight cover that would form the desired aerodynamic shape and provide the desired sole shape. In general, the rigidity of the cover becomes less important for either an iron or a wood club head as its mass decreases. A hosel for the golf club shaft is provided out of low-density, rigid material and is attached to the striking plate, the inertial ring, the cover, or to any combination of them.

For a putter head, the difference in density of the materials is generally less important than for the iron and the wood as the striking plate is not generally as large in relation to the vertical width of the inertial ring. For the impact velocities encountered with a putter, it is easy to make the putter behave as a rigid body, so no stiffening ribs or plates between the striking plate and the inertial ring are needed. This means the entire mass can be concentrated at perimeter of the combined club head shape resulting in the optimum moments of inertia. The cover between the striking plate and the inertial ring can be as simple as a single layer of plastic material closing the hole formed between the plate and ring. The mass attributed for the cover would be negligible.

For an iron head, the use of a low-density material for the striking plate is more important than for a putter head. This is because the vertical size of the striking surface is large relative to that of the inertial ring. The inertial ring must be smaller in order to avoid interference with the ground. In addition, the club face of an iron is inclined from the vertical, placing the mass of the striking plate closer to the center of gravity. This proximity of the mass of the striking plate to the center of gravity decreases the overall moments of inertia of the club. So, by making the face out of low-density material, the majority of the mass can be placed in the inertial ring, maintaining high moments of inertia. As in the case of the putter, the mass attributed to the cover would be negligible.

For a wood head, the need for a low-density material for the striking plate is even greater than for an iron head. In addition to the considerations for the iron above, the striking plate will compete directly with the aerodynamic cover for available mass. The aerodynamic cover needs to be as light as possible, but should still be relatively rigid and durable. The aerodynamic cover has to have a much larger surface area than the putter or iron cover. In addition, the sole portion of the cover must have a durable surface and sufficient structural integrity to withstand impact and scraping against rocks and other material. As a result, the aerodynamic cover for a wood will consume a more significant portion of the mass of the club head—leaving less mass available for the striking plate and the inertial ring.

DETAILED DESCRIPTION

Figure 1:
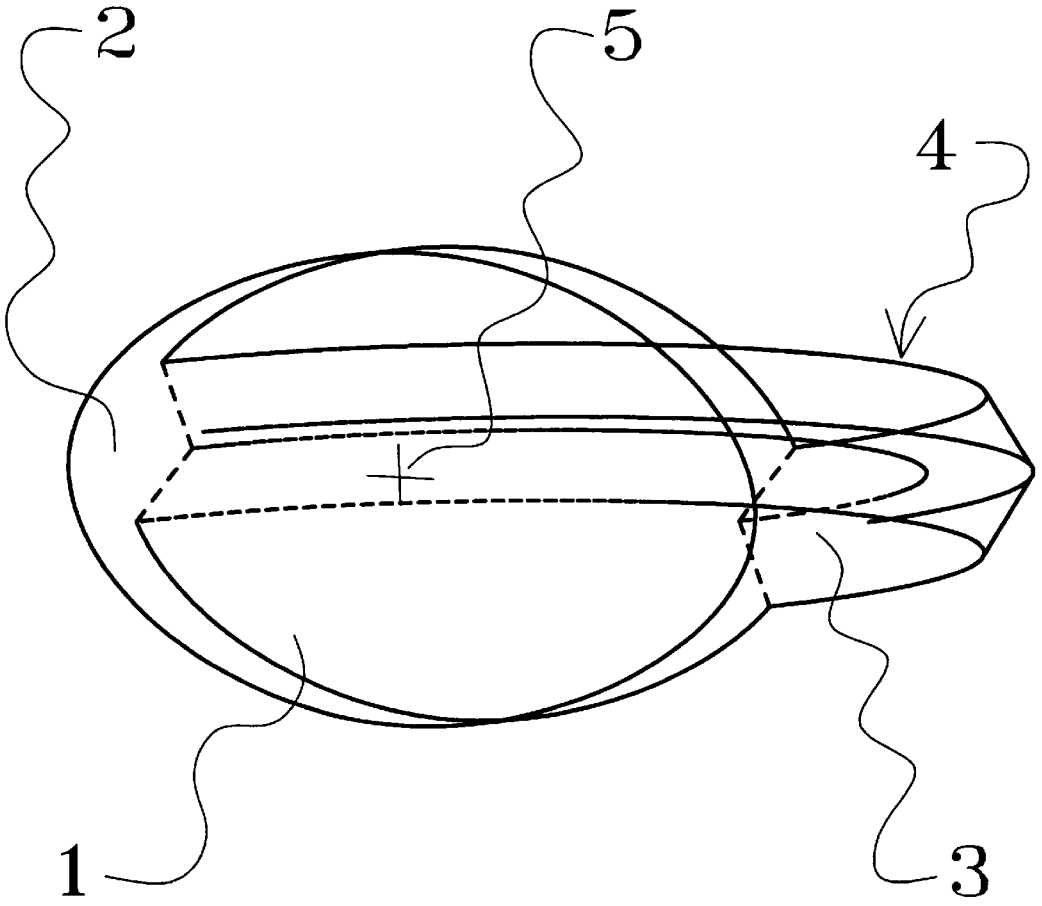
FIG. 1 is a sketch of the striking member and the ring member from a frontal oblique viewpoint. The dashed lines represent hidden features. This view does not show the shaft receptacle. The shapes are simplified for ease of drawing and do not represent an optimum shape for a striking surface or the optimum profile of the rearward extent. This view also does not show an aerodynamic cover, which would be used for wood-type club heads.
Figure 2:
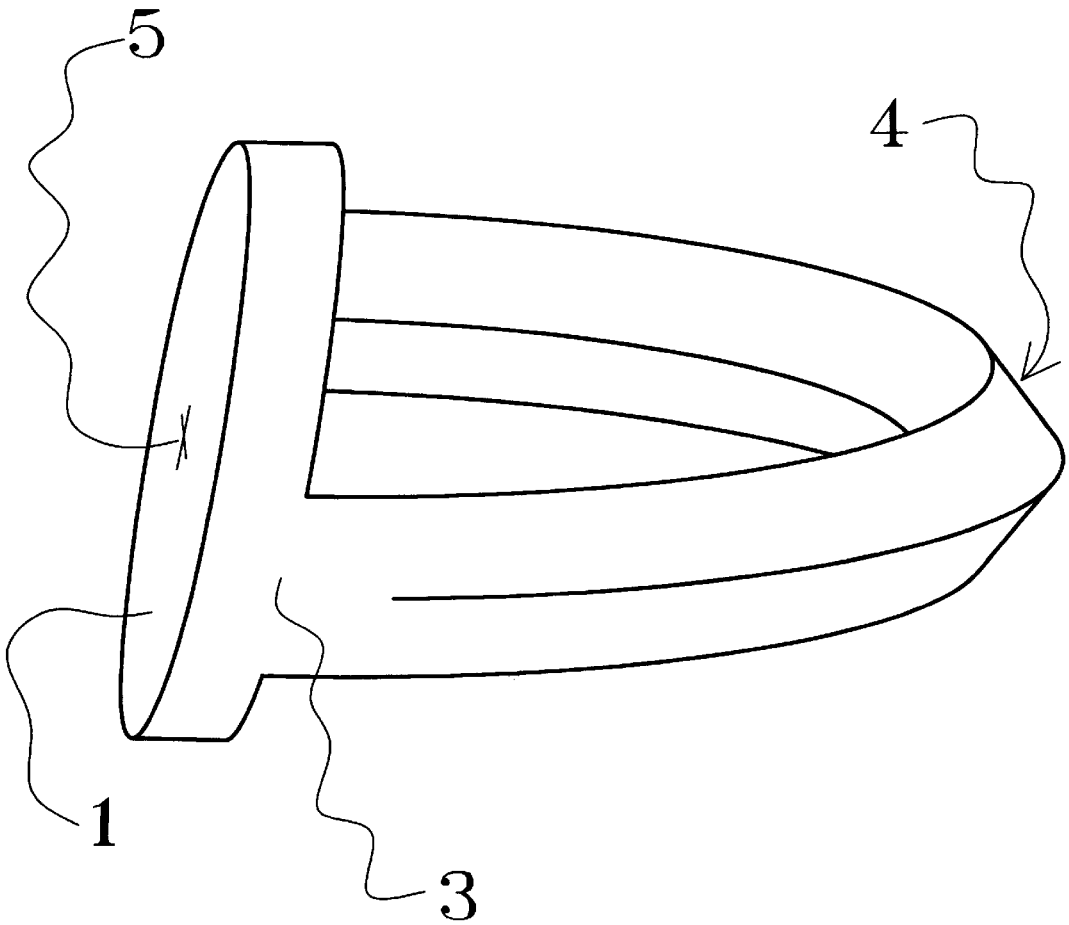
FIG. 2 is a sketch of the same object as FIG. 1 from a side oblique perspective.
Figure 3:
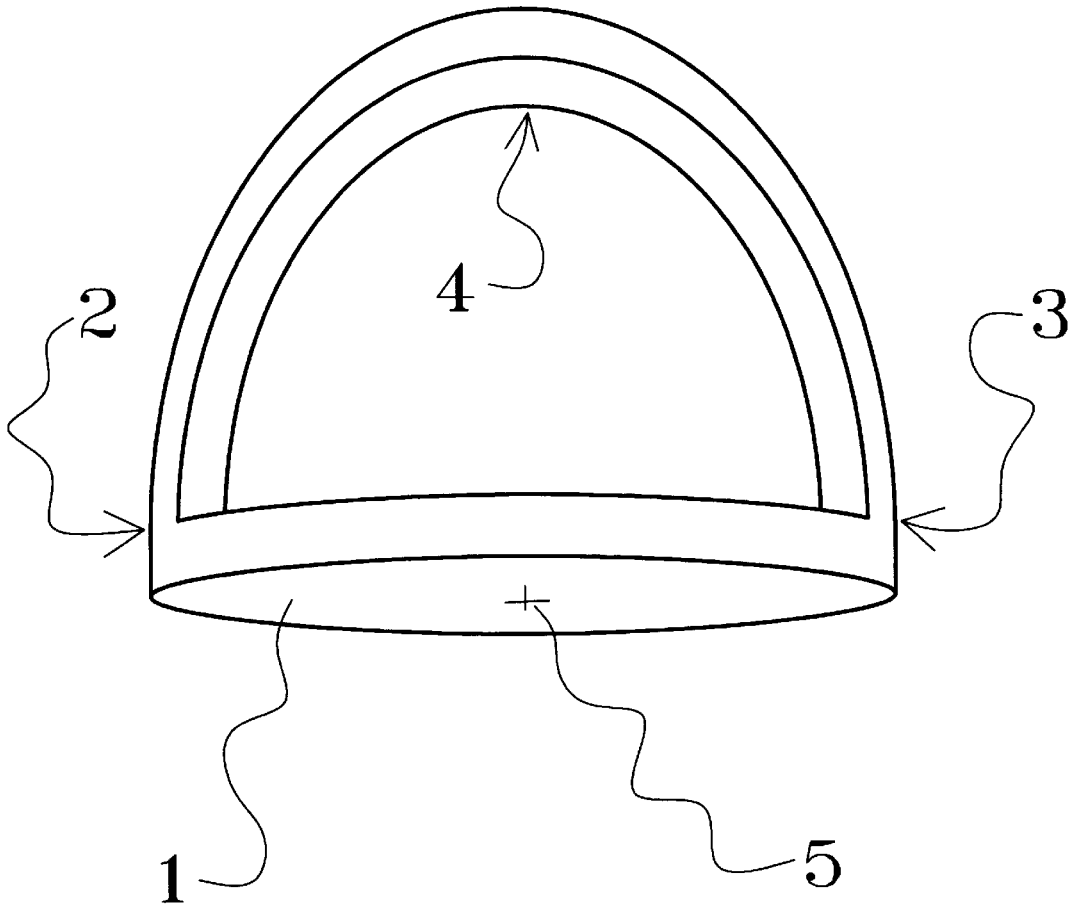
FIG. 3 is a drawing of the same object as FIG. 1 as seen from the top.

The present invention as disclosed describes right-handed golf club heads, for which the heel is to the right of the head when viewed from in front of the striking member. The present invention applies equally to left-handed clubs in which the geometry is reversed. Referring to FIGS. 1, 2, and 3, what is proposed is a golf club head, which consists of a striking member 1 that is rigidly attached at its toe portion 2 and heel portion 3 to ring member 4. Ring member 4 adds to the rigidity of striking member 1 and provides increased inertial resistance to deflection upon contact with the ball at striking surface 5. FIGS. 1, 2, and 3 indicate that striking member 1 and ring member 4 can be integrally formed of a single homogeneous material. Alternatively, ring member 4 can be made of a separate material, which is attached by some means to striking member 1. In the preferred embodiment, striking member 1 is made of a rigid, low-density material and ring member 4 is made of a rigid, high-density material. In the preferred embodiment, the means of attachment of the ring member 4 to striking member 1 would be to create aft-facing receptacles at the toe portion 2 and the heel portion 3 of striking member 1. These receptacles would be slightly larger and of similar shape to the ends of ring member 4 and would be used to insert the ends of ring member 4 for attachment by some mechanical means, with an adhesive, or by fusion of the materials to form a bond. A further feature of the preferred embodiment would be to attach a high fracture-toughness material to the lower portion of the striking surface 5 on striking member 1 and along the under-side of striking member 1 to provide greater durability.

Figure 4:
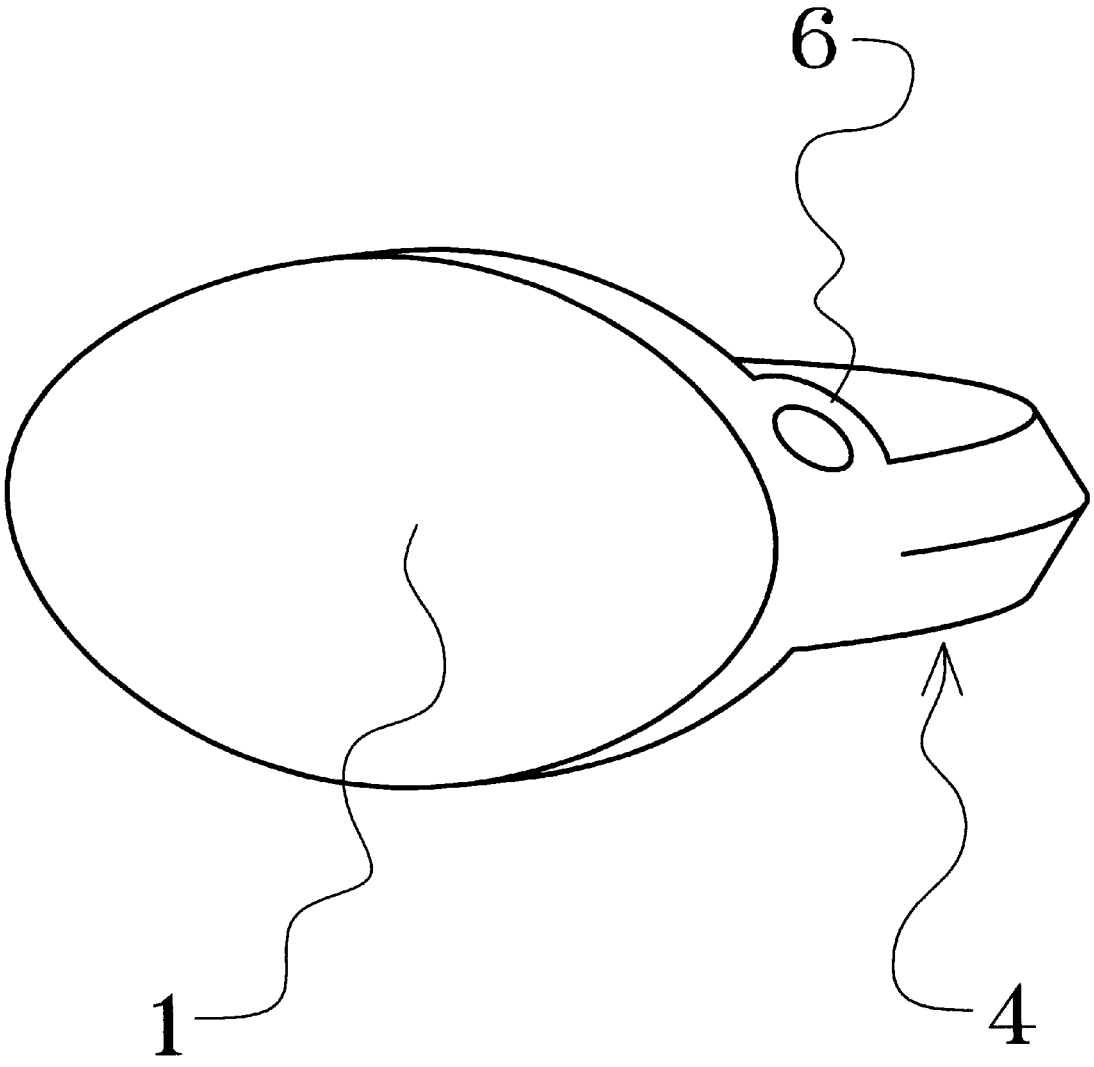
FIG. 4 shows a possible location for the shaft receptacle. In this case, the receptacle is formed at the intersection of the striking member and the ring member and is shown as a recessed cavity for insertion of a golf club shaft.
Figure 5:
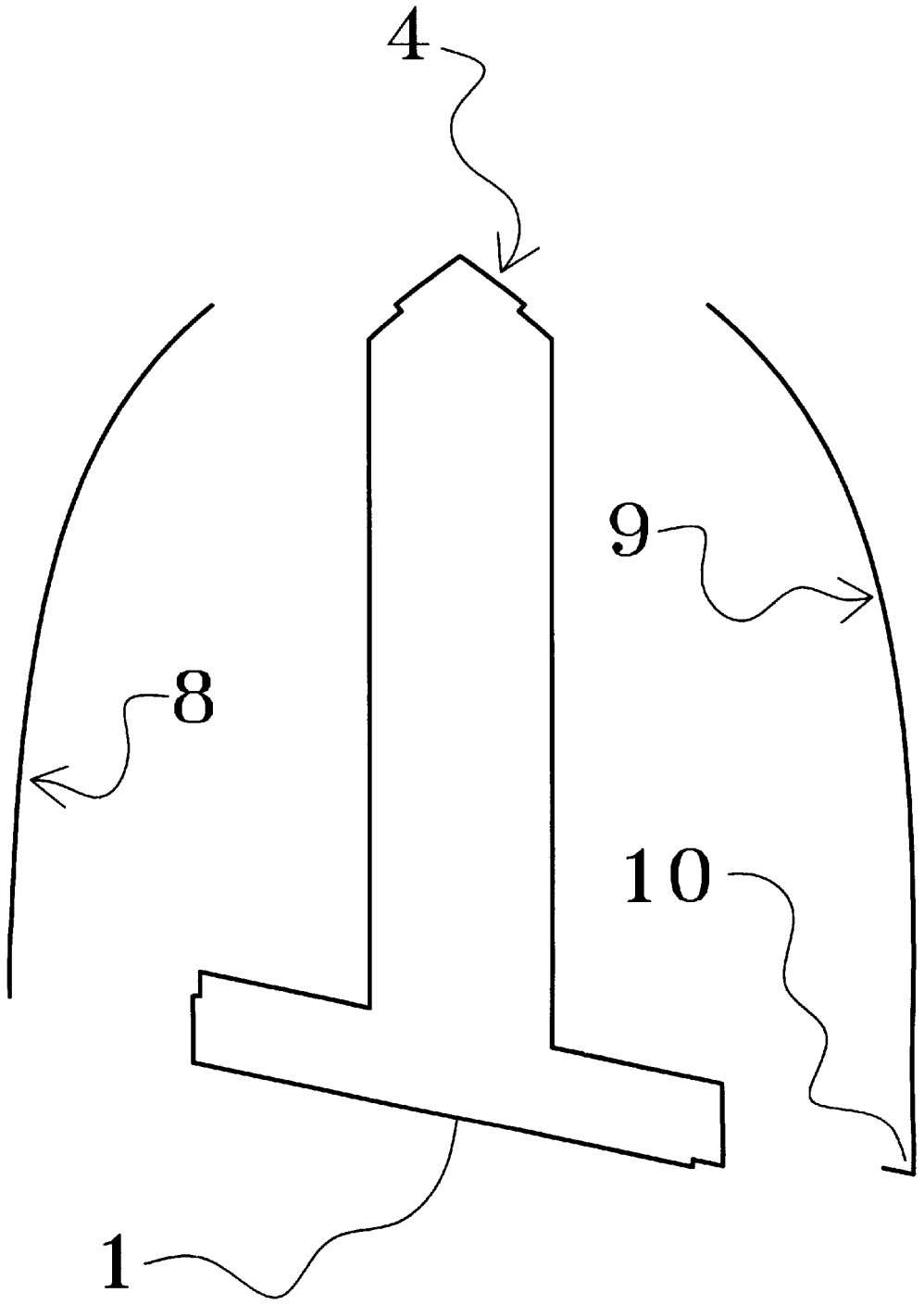
FIG. 5 shows a side cut-away view of the striking member and ring member with a two-piece aerodynamic afterbody. This version of the afterbody has an extension of the lower surface which also extends upward to cover the lower portion of the striking member.

Referring to FIG. 4, striking member 1 is also rigidly attached to a hosel 6 for attachment of a golf club shaft. FIG. 4 shows that striking member 1, ring member 4, and hosel 6 can be integrally formed of a single homogeneous material. Hosel 6 is shown as an insert flush with the surface of the club head. However, hosel 6 can be made to extend outward from the surface as well. Hosel 6 can be made of a different material than striking member 1 or ring member 4 and can be attached to striking member 1, to ring member 4, or to both by mechanical means, with an adhesive, or by fusion of the materials to form a bond. In the preferred embodiment, hosel 6 would be integrally formed with striking member 1 of a single homogenous material. The configuration shown in FIG. 4 could be used for putter or iron club heads or for wood heads as shown in FIG. 5 and discussed below. To conform to current regulations on golf club design, the hole formed by striking member 1 and ring member 4 would have to be closed for use as a putter or an iron. In the preferred embodiment for a putter or iron club head, a very low-density plate would be attached by some means to striking member 1 and ring member 4 to close the hole.

Referring to FIG. 5, the preferred embodiment for wood-type club heads includes a top cover 8 and a bottom cover 9 which attach to striking member 1 and to ring member 4. Top cover 8 can be formed of any lightweight, durable material with high rigidity. Top cover 8 can be formed integrally with hosel 6, or hosel 6 can be attached by some means to top cover 8 or to any combination of striking member 1, ring member 4, and top cover 8. Bottom cover 9 has an extension 10, which extends past the bottom edge of striking member 1 and partially covering the lower portion of the front of striking surface 5. This extension 10 of bottom cover 9 would be constructed of a material of high fracture toughness and scratch resistance to withstand repeated impacts with rock or other hard materials. In the preferred embodiment for an iron, extension 10 of bottom cover 9 would be used without bottom cover 9 to provide the same protection against impacts as described above. Bottom cover 9 would preferably be constructed of high fracture toughness, scratch resistant material on its lower-most portion, which is most likely to strike or scrape the ground during a swing. The use of separate top and bottom covers has the effect of minimizing the material allocated to the cover, thereby increasing the material in the hoop for even greater moments of inertia and stiffness. It also has the effect of placing the hoop material at a larger distance from the center of mass, which yields a further increase in the moments of inertia and stiffness. In addition, it reduces the covers to convex shell segments of small angular extent, which are rigidly attached along their entire boundary. This type of shell is the most rigid configuration for a cover—reducing the mass required to achieve high rigidity.

Figure 6:
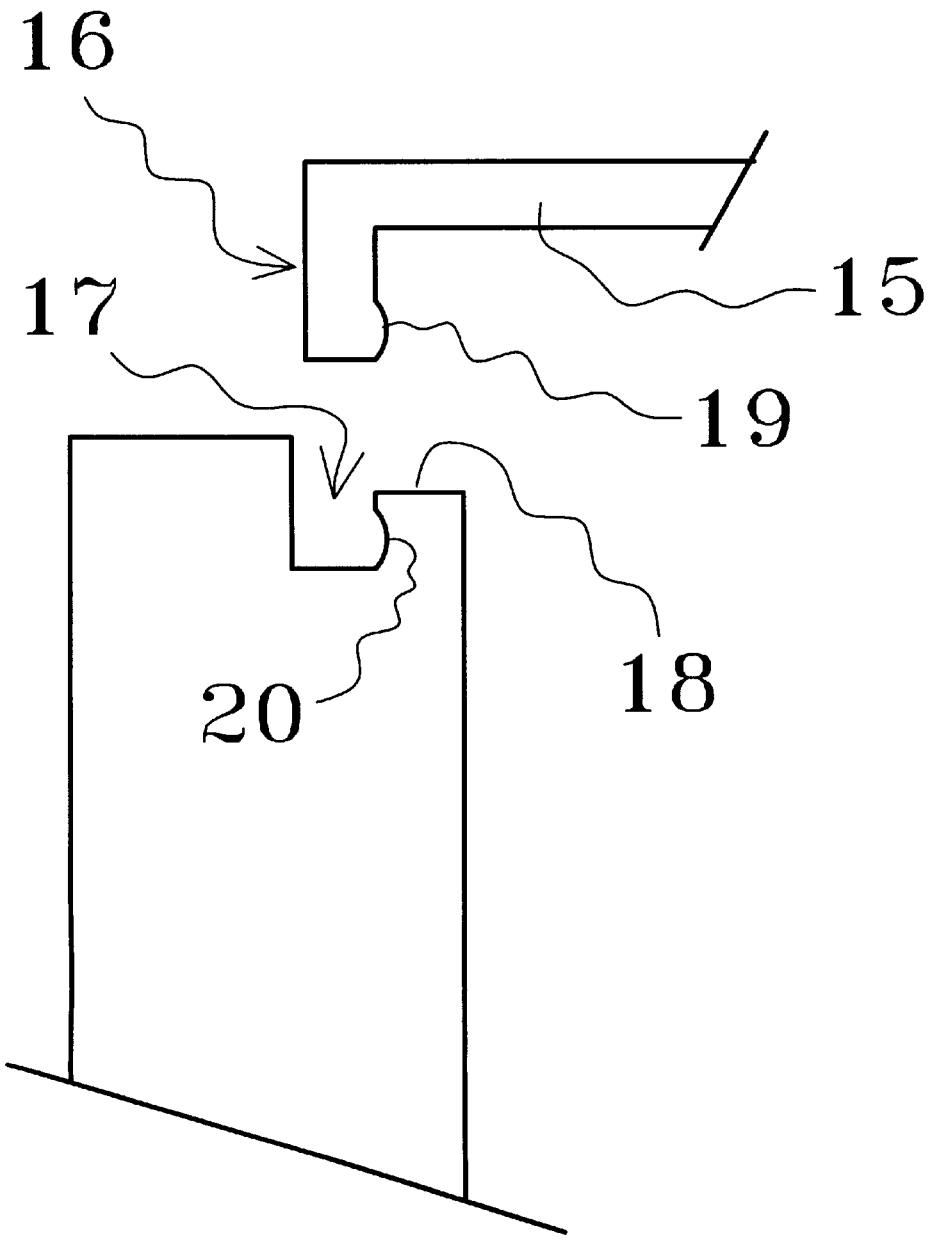
FIG. 6 shows a side cut-away view of a striking member and a leading edge of an aerodynamic afterbody, which demonstrates a tongue and groove configuration where the tongue has a geometry which will snap into the groove for additional stability.

Referring to FIG. 6, a proposed enhancement to the means of attachment of top cover 8 and bottom cover 9 to striking member 1 and ring member 4 is shown. This enhancement involves a tongue and groove joint where the edge of a cover 15 has a tongue 16, which inserts in a groove 17 in the attachment surface of a surface 18. Also shown is a bead 19, which provides a positive attachment by means of snap-together assembly with the aid of depression 20.

Referring to FIGS. 5 and 6, the covers are attached to striking member 1 and ring member 4 and, depending on the specific configuration, to hosel 6. This attachment can be by any of a variety of bonding methods including adhesives, mechanical attachments such as rivets or screws, and fusion to form a material bond.

An example, using specific design details, will best explain the improvements achieved by this invention. The focus of this example is to provide a wood-type golf club head that provides the ability to achieve low mass, high moment of inertia about the vertical axis, high rigidity, a large striking surface, and low aerodynamic drag. Silicon nitride is selected as the material of striking member 1 for its excellent mechanical properties. Silicon nitride is about 30% lighter than titanium and 300% stiffer. It is also 55% lighter than stainless steel and still 50% stiffer. Tungsten is selected as the material of ring member 4 for its good mechanical properties and excellent inertial efficiency. Tungsten is 50% more rigid and much denser than steel. Graphite epoxy is used for top cover 8 and for the upper edges of bottom cover 9. This material is selected to conserve weight. The bottom or sole portion of bottom cover 9 is titanium for durability. The pertinent properties of several materials are listed in table 1.

TABLE 1

Typical Material Properties

| Material | Elastic Modulus (GPa) | Yield Strength (MPa) | Density ($Mg/m^3$) | Fracture Toughness ($MPa(m)^{1/2}$) |
|---|---|---|---|---|
| Stainless Steel | 200 | 1000 | 8.0 | 55 |
| Titanium | 110 | 1000 | 4.4 | 44–66 |
| Silicon Nitride | 320 | 1200 | 3.2 | 8.5 |
| Graphite Epoxy | | | 1.5 | |
| Tungsten | 330 | 600 | 19.3 | |

Using these properties and basic geometric shapes such as a semi-ellipsoid to represent the golf club head, a comparison can be made of inertial resistance to rotation. A typical, state-of-the-art driver or #1 wood would be made of titanium, weigh approximately 200 gm, and have a volume of approximately 200 cc. Using idealized shapes as described below, a hollow titanium driver will provide 37% greater moment of inertia about the yaw axis than a solid driver of equal size and weight. The hollow driver will also provide 47% greater moment of inertia about the pitch axis than a solid driver will. Using the same overall dimensions and weight, but substituting the materials described above, the present invention provides an additional 37% improvement over the hollow titanium driver for the yaw-axis moment of inertia and another 21% improvement for the pitch-axis moment of inertia. The improvements in moments of inertia provided by the present invention are 88% for the yaw axis and 79% for the pitch axis when compared with those of the solid driver. The other significant advantage of the present invention is that the use of advanced materials in the optimum configuration disclosed herein will provide a club head with significantly greater rigidity than a hollow titanium driver. Both tungsten and silicon nitride have three times the rigidity of titanium, so if the main structure consisting of the striking face and the inertial ring is made of these materials, the improvement in stiffness will be significant. Determining the magnitude of the increase in stiffness would require significant computational resources.

The improvements in moments of inertia described above are derived from the following calculations. A solid driver is represented as a semi-ellipsoid with an elliptical plate coincident with its planar surface. The front surface of the elliptical plate represents the striking face and the remaining surfaces represent the aerodynamic afterbody. For ease of calculations, the origin is placed at the center of the planar surface of the semi-ellipsoid, which is also the center of the rear surface of the plate. The plate has a thickness of 0.48 cm. The large semi-axis of the ellipsoid is the z-axis and extends 7.6 cm to the rear of the afterbody. The middle semi-axis is the y-axis and extends 5 cm to the right lateral edge of the planar face. The small semi-axis is the x-axis and extends 2.2 cm to the top edge of the face. The moments of inertia of the ellipsoid and the plate about the origin are added to obtain the moments of inertia of the solid driver about the origin. These values about the origin are calculated using the formulas in table 2 below. They are then translated to the center of gravity (c.g.) using the parallel axis theorem. As an example, the translation of the moment of inertia about the x-axis is given by the formula $I_{xx}=I_{xx}+md^2$, where $I_{xx}$ is the moment of inertia about the x-axis with the origin at the c.g., $I_{xx}$ is the moment of inertia about the x-axis with the origin as described above, m is the mass, and d is the distance between the two origins. The distance d to the center of gravity is found by the sum of moments method. As an example, the distance d is found by solving the equation $md=m_1d_1+m_2d_2$ where m is the total mass, $m_1$ is the mass of object 1, $d_1$ is the distance from the starting origin to the center of gravity of $m_1$, and similarly for $m_2$. The resulting moments of inertia are shown in table 3 below.

A hollow titanium driver is represented as a semi-ellipsoidal shell and an elliptical plate. The shell is simulated by subtracting the moments of inertia of two semi-ellipsoids. The larger one is the size of the previous example and the smaller is 2.1 mm smaller along each radius. The result is a shell that is 2.1 mm thick. The moments of inertia of the two ellipsoids are calculated based on the mass that would exist for a solid ellipsoid of the chosen density for the shell. When the two inertias are subtracted, the value remaining represents the inertia of the shell with the appropriate mass. The elliptical plate has the same dimensions as those described above. The hollow driver is represented as having the same mass as the solid driver by using the greater density of titanium.

The present invention is represented as another collection of simple shapes. The shell has the same outer dimensions, but has a thickness of 1.3 mm and the lower density of plastic. A titanium sole plate is represented by a two-dimensional, semi-elliptical plate in the x-z plane. The sole plate has a mass density which, when added to the corresponding material in the shell, simulates the density of titanium for the sole portion. The sole plate has a major semi-axis of 8 cm and a minor semi-axis of 4 cm. It is position such that the linear edge is aligned in the z-direction with the front of the striking face. The striking face is again an elliptical plate and has the same dimensions used previously, but has the lower density of silicon nitride. The ring is represented by subtracting the moments of inertia of two semi-elliptical plates. The larger one has the radii of the shell in the x-z plane, and the smaller one has radii that are 5 mm smaller. This results in a ring with a radial thickness of 5 mm. The plate thickness is set at 5.3 mm in order to provide a total mass of the driver that is equal to that of the solid driver and the hollow driver described above.

TABLE 2

Formulae for Shapes

| Shape | c.g. Location | $I_{xx}$ | $I_{yy}$ |
|---|---|---|---|
| Semi-Ellipsoid | $\frac{3z}{8}$ | $\frac{m(y^2+z^2)}{5}$ | $\frac{m(x^2+z^2)}{5}$ |
| Elliptical Plate in x-y Plane, thickness h, origin on rear surface | | $\frac{my^2}{4}+\frac{mh^2}{3}$ | $\frac{mx^2}{4}+\frac{mh^2}{3}$ |
| Semi-Elliptical Plate in y-z Plane, thickness h, origin at center of planar edge | $\frac{4z}{3\pi}$ | $\frac{m(y^2+z^2)}{4}$ | $\frac{mz^2}{4}+\frac{mh^2}{12}$ |
| 2-D Semi-Ellipse in y-z Plane, origin at center of linear edge | $\frac{4z}{3\pi}$ | $\frac{m(y^2+z^2)}{4}$ | $\frac{mz^2}{4}$ |

TABLE 3

Example Club Head Properties

| Item | Shape | Material | Density ($g/cm^3$) | Mass (g) | Ixx ($g\text{-}cm^2$) | Iyy ($g\text{-}cm^2$) |
|---|---|---|---|---|---|---|
| Solid Head | | | | 195 | 1760 | 950 |
| Face | Elliptical Plate | N/A | 1.02 | 17 | | |
| Body | Semi-Ellipsoid | N/A | 1.02 | 178 | | |
| Titanium Head | | | | 195 | 2420 | 1400 |
| Face | Elliptical Plate | Titanium | 4.43 | 73 | | |
| Shell | Semi-Ellipsoid Shell | Titanium | 4.43 | 122 | | |
| Proposed Head | | | | 195 | 3310 | 1700 |
| Face | Elliptical Plate | Silicon Nitride | 3.2 | 53 | | |
| Shell | Semi-Ellipsoid Shell | Graphite Epoxy | 1.5 | 26 | | |
| Sole | 2-D Elliptical Plate | (Correction for titanium sole) | 2.93 | 19 | | |
| Ring | Elliptical Ring | Tungsten | 19.3 | 97 | | |

NOTE: Combination of sole mass and lower part of shell mass represents a titanium sole.

In the case of an iron, a similar example also uses silicon nitride for the striking face and tungsten for the inertial ring. The mass of the cover for an iron is assumed to be negligible. When comparing the inertial properties, the advantages for an iron are even more significant than for a driver. The typical perimeter weighted iron provides an approximately 20% increase in inertial resistance about a vertical axis and a 45% increase for the lateral axis. The present invention as outlined in this example provides an additional 210% increase in vertical-axis moment of inertia and a 430% increase in lateral-axis moment of inertia. While this version of an iron is unusual in appearance because it has a ring extending aft of the striking face, the ring would not interfere with use of the club. Similar advantages can be obtained by use of the present invention for a putter.

The above examples were developed by maintaining the size and weight of particular club head designs and optimizing rigidity and inertial properties simultaneously. Alternately, this invention could be applied to create a larger head while maintaining equal or greater rigidity to current titanium heads. This would result in a head with even greater improvements in moments of inertia. Another option would be to create a lighter head while maintaining some of the rigidity and moments of inertia improvements. This would result in the ability to have a longer shaft for higher club head velocity resulting in greater distance. In addition, the location of the center of mass can be optimized for the appropriate desired effect. A detailed design using this invention will provide a club head with negligible energy absorption on impact and maximized stability during off-center hits. This means the ball will travel further and straighter than one struck by current wood-type heads.

As discussed above, variations of this invention would include maximizing individual properties at the expense of other properties. This can include maximizing the moment of inertia about any axis, maximizing the size of the striking surface as mentioned above, maximizing the rigidity of the striking surface, optimizing the location of the center of gravity, and optimizing the weight distribution of the club head for dynamic balancing. In addition, this invention can be refined by using the shape of the aerodynamic covers to provide various aerodynamic forces during a swing including lift force, side force, symmetric drag, asymmetric drag, pitching moment, or yawing moment or any combinations thereof to produce some desired effect on the golf swing.

While preferred embodiments of the invention have been described, it will be apparent to those skilled in the field of the invention that various changes and modifications may be made in practicing the invention without departing from the scope and spirit thereof, and therefore the invention is not to be limited except as defined in the appended claims.

What is claimed is:

1. A golf club head consisting of:

a) A first mass defined by a striking member of some thickness and cross-sectional shape and having a density of 3 to 9 $Mg/m^3$, said first mass having a front striking portion, a rear portion, and first and second lateral ends;

b) A second mass having a density of greater than 12 $Mg/m^3$ rigidly attached to said rear portion of said first mass at said first and said second lateral ends, said second mass having some thickness and cross-sectional shape;

c) Said second mass disposed arcuately rearward to form a ring with said first mass;

d) A third mass having a density of less than 2 $Mg/m^3$ which forms a top cover adjoined to said first mass and said second mass;

e) A fourth mass which forms a receptacle for receiving a golf club shaft, said fourth mass rigidly attached to one or both of: said first mass, said second mass;

f) A fifth mass which forms a bottom cover adjoined to said first mass and said second mass.

* * * * *